United States Patent [19]

Eriksson

[11] 4,080,119

[45] Mar. 21, 1978

[54] METHOD AND DEVICE FOR DRAINING OIL FROM THE GEAR CASE OF A COMPRESSOR

[76] Inventor: Sven Evald Eriksson, Edegem, Belgium

[21] Appl. No.: 751,798

[22] Filed: Dec. 17, 1976

Related U.S. Application Data

[63] Continuation of Ser. No. 587,829, Jun. 18, 1975, abandoned.

[30] Foreign Application Priority Data

Jun. 24, 1974 Sweden ..... 7408228

[51] Int. Cl.[2] ..... F01C 21/04; F04C 29/02; F01M 1/04

[52] U.S. Cl. ..... 418/97; 418/201; 184/6.16; 418/100

[58] Field of Search ..... 418/88, 97–100, 418/197, 201–203; 184/6.11, 6.16; 415/110, 112, 122 R; 60/39.08

[56] References Cited

U.S. PATENT DOCUMENTS

| | | | |
|---|---|---|---|
| 2,305,317 | 12/1942 | Nickell | 418/97 |
| 2,862,655 | 12/1958 | Dickson | 418/98 |
| 3,138,320 | 6/1964 | Schibbye | 418/201 |
| 3,291,385 | 12/1966 | Williams et al. | 418/99 |
| 3,796,526 | 3/1974 | Cawley | 418/97 |
| 3,820,923 | 6/1974 | Zweifel | 418/99 |
| 3,856,493 | 12/1974 | Bulkley | 418/99 |
| 3,910,731 | 10/1975 | Persson et al. | 418/201 |

*Primary Examiner*—John J. Vrablik
*Attorney, Agent, or Firm*—Eric Y. Munson

[57] ABSTRACT

A method and a device for draining oil from the gear case of an oil-injected rotary compressor is disclosed in which a pressure is taken out from the compressor to pressurize the gear case so as to drive the oil, against the action of gravity, to a low pressure area of the compressor.

4 Claims, 4 Drawing Figures

METHOD AND DEVICE FOR DRAINING OIL FROM THE GEAR CASE OF A COMPRESSOR

This is a continuation, of application Ser. No. 587,829 filed 6/18/75, now abandoned.

SUMMARY OF THE INVENTION

The present invention relates to a method and a device for draining oil from the gear case of an oil-injected rotary compressor.

In those cases in which it has not been practically possible to place the compressor so that its inlet has been at the lowest point of the machine a pump has been used for draining the gear case.

According to the present invention which has the characteristics set forth in the accompanying claims the gear case is drained without a pump.

DETAILED DESCRIPTION OF DIFFERENT EMBODIMENTS OF THE INVENTION

Figure 1:
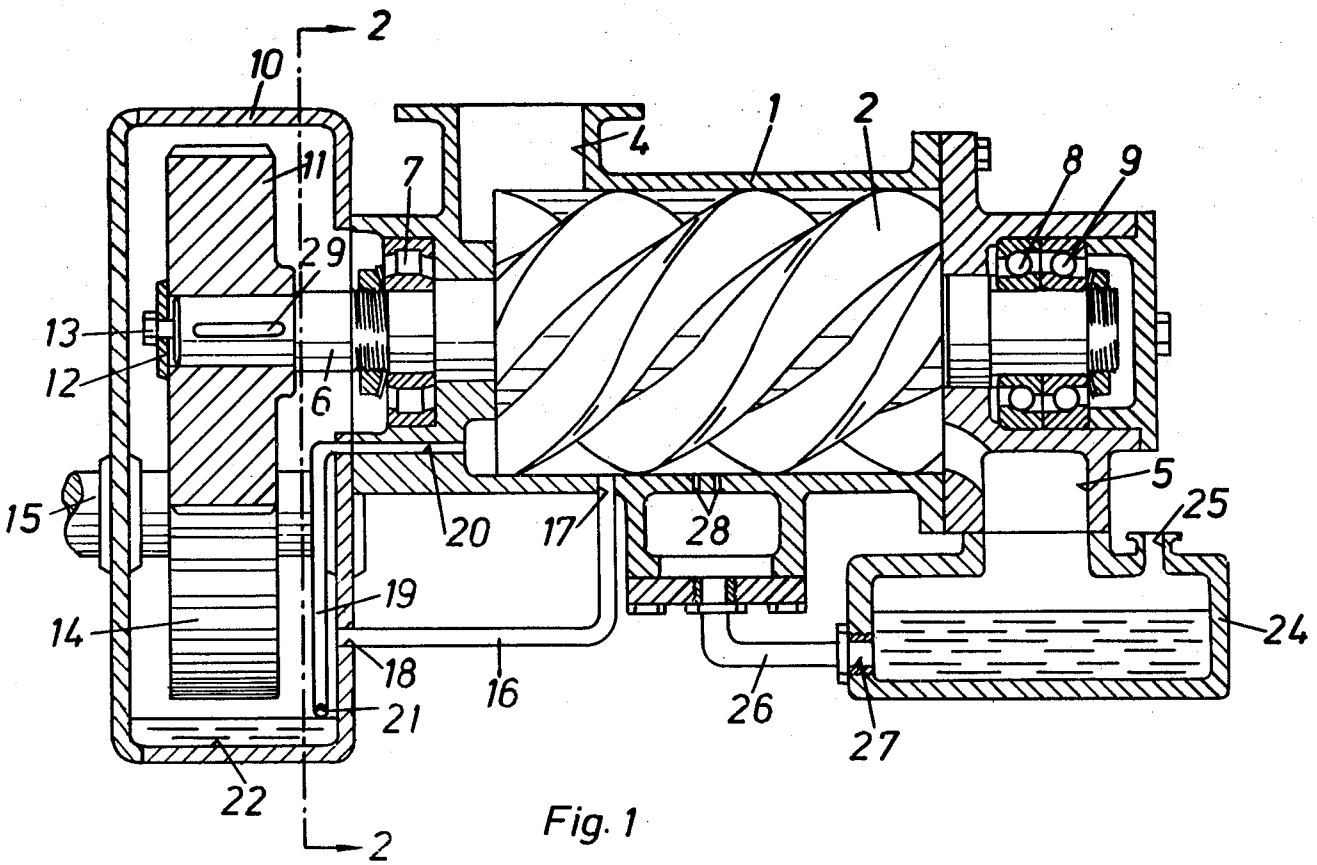
FIG. 1 shows a longitudinal section of a screw compressor embodying the invention.
Figure 2:
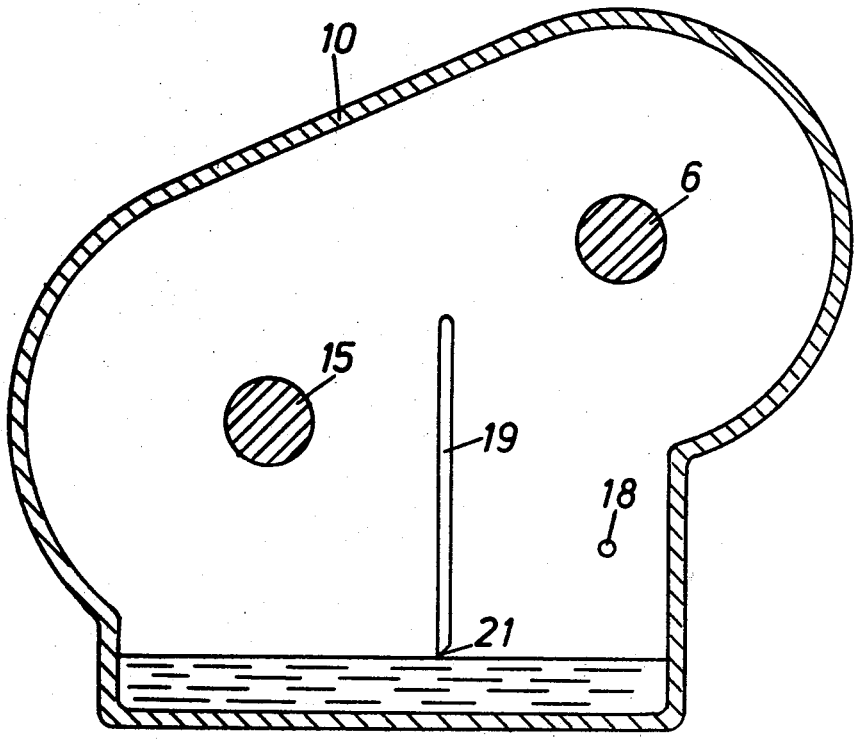
FIG. 2 shows a section taken on the line 2—2 in FIG. 1.

The screw compressor shown in FIGS. 1 and 2 comprises a housing 1 in which a main rotor 2 and a gate rotor not shown are journalled in bearings 7, 8 and 9. When the compressor is in operation gas is conveyed while being compressed from the inlet channel 4 to the outlet channel 5 and the receiver 24. The receiver 24 is provided with an air outlet 25. The lower part of the receiver serves as an oil container. Oil is driven by the pressure in the receiver through the hole 27 in the receiver, the conduit 26 and the holes 28 in the machine housing 1 in order to lubricate the rotors and to cool the working medium. In order to simplify the description the conventional separation devices for the oil and valves have been omitted. The main rotor 2 is provided with an axle 6 on which a toothed wheel 11 is mounted by means of a key joint 29, a plate 12 and a screw 13. The toothed wheel 11 cooperates with a toothed wheel 14. The toothed wheels are enclosed in a gear box housing 10 which is mounted on the machine housing 1. The toothed wheel 14 is provided with an axle 15 to which a driving motor is connectable. The housing 1 is provided with a hole 17 through which a pressure created by the compressor is conducted to a first conduit 16 and through the hole 18 in the gear box housing 10 for pressurizing the gear case. The oil which is sprayed on the toothed wheels for lubricating the gear transmission 11, 14 is driven by the pressure in the gear box against the force of gravity through a second conduit 19, which has an opening 21 near the bottom 22 of the gear box, and the hole 20 in the housing 1 to an area in the compressor where the pressure is lower than at the hole 17.

Figure 3:
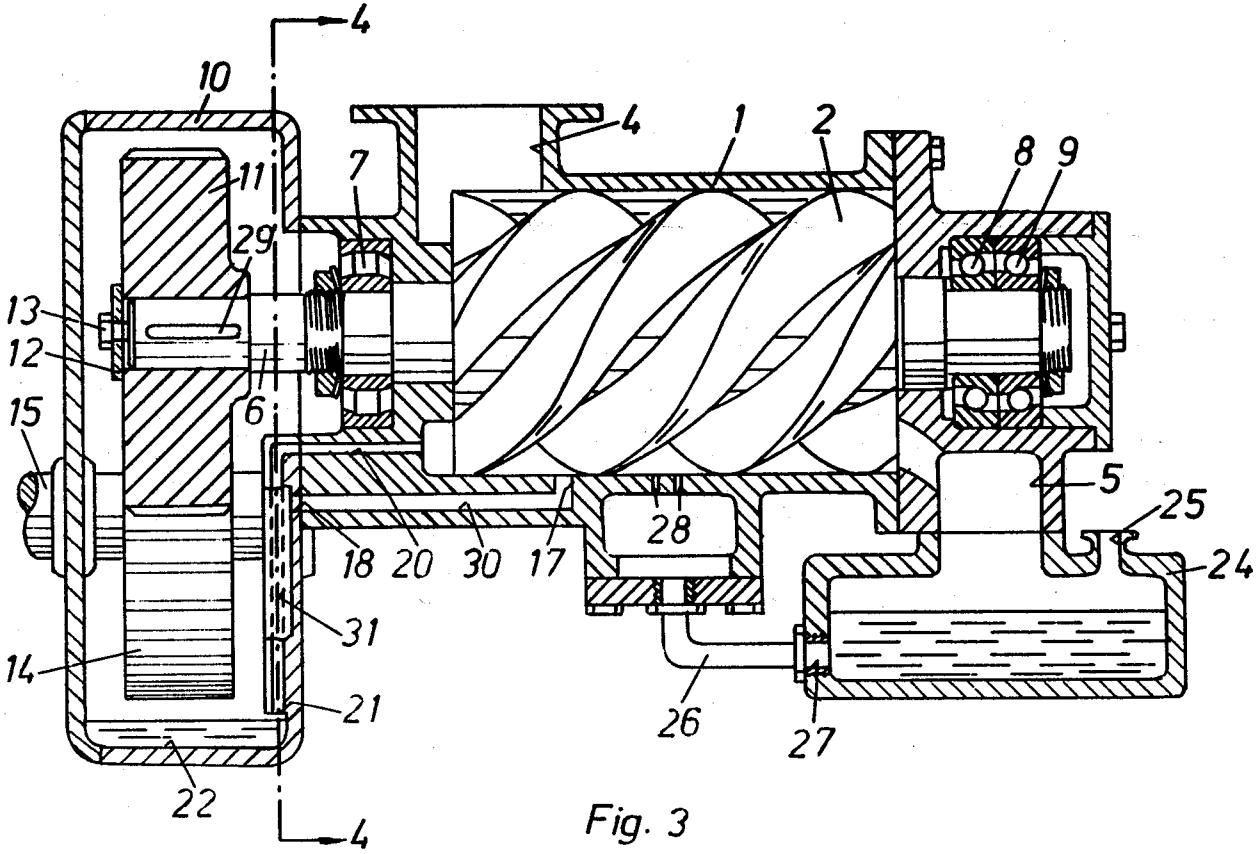
FIG. 3 shows a longitudinal section of a second embodiment of a screw compressor.
Figure 4:
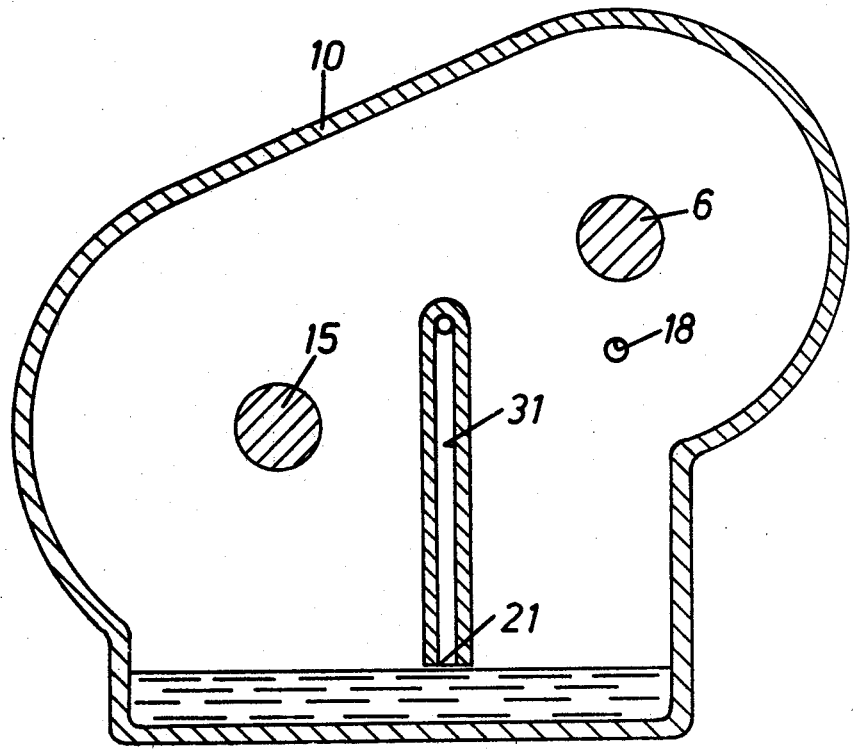
FIG. 4 shows a section taken on the line 4—4 in FIG. 3.

The screw compressor according to FIGS. 3 and 4 differs from the screw compressor according to FIGS. 1 and 2 only by the fact that the first and second conduits 16, 19 have been replaced by a first channel 30 and a second channel 31.

The above described and in the drawings shown embodiments of the invention are only to be regarded as examples which may be modified within the scope of the subsequent claims.

What I claim is:

1. The method of draining a fluid lubricant from the oil sump in the gear box of a normally non-pressurized transmission mechanism and injecting said lubricant into a higher level compression chamber of a comression apparatus housing the rotors which are driven by said transmission mechanism, said method comprising: pressurizing the gear box by withdrawing a stream of compressed working medium from an intermediate compression stage in the compression chamber and injecting it into the gear box at a point located above the oil level therein, utilizing the resultant pressure within the gear box to drive lubricant from the oil level in said sump upwardly within a duct against the force of gravity and injecting it into the compression chamber at a point of lower compression pressure than that prevailing at said intermediate compression stage.

2. The method according to claim 1, which includes the further step of injecting into the compression chamber, at a stage of higher compression than that of said intermediate stage, a stream of lubricant fluid separated from the working medium at the completion of the compression cycle and stored in the collection zone under pressure by the compressed working medium and driving said stream by differential pressure into said higher compression stage.

3. A compression apparatus comprising:

a. a compression chamber having an inlet and an outlet for a gaseous working medium;

b. rotors housed within said compression chamber for compressing the working medium;

c. a lubricated transmission mechanism for driving said rotors;

d. a gear box enclosing said transmission mechanism having a bottom sump for the lubricant located at a level lower than said compression chamber and being normally sealed therefrom;

e. means for draining lubricant from said sump and injecting it into said compression chamber, said means comprising:

i. conduit means for withdrawing compressed working medium from an intermediate compression stage in said compressor chamber and injecting it into said gear box at a point above the lubricant level therein to maintain the latter pressurized by said working medium, and ii. separate conduit means for forcing lubricant upwardly from the lubricant level in said sump against the force of gravity and injecting it into said compression chamber at a point of lower compression pressure than that prevailing at said intermediate stage.

4. A compression apparatus according to claim 3, also comprising a reservoir for collecting and storing the lubricant separated from the compressed working medium upon final compression while being maintained under pressure by the compressed working medium, and conduit means for injecting said separated lubricant from said reservoir into said compression chamber at a point of higher compression pressure than that prevailing at said intermediate stage.

* * * * *

UNITED STATES PATENT OFFICE

CERTIFICATE OF CORRECTION

Patent No. 4,080,119 Dated March 21, 1978

Inventor(s) Sven Evald Eriksson

It is certified that error appears in the above-identified patent and that said Letters Patent are hereby corrected as shown below:

[73] Assignee: ATLAS COPCO AKTIEBOLAG
Nacka, Sweden

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*